US006371677B1

(12) United States Patent
Lee

(10) Patent No.: US 6,371,677 B1
(45) Date of Patent: Apr. 16, 2002

(54) MOLDED PEN CAP WITH BIASING CLIP

(75) Inventor: Yeou-Ching Lee, Taipei (TW)

(73) Assignee: Alvin Lee Jewelry, Inc., Taipei (TW)

( * ) Notice: Subject to any disclaimer, the term of this patent is extended or adjusted under 35 U.S.C. 154(b) by 0 days.

(21) Appl. No.: 09/858,395

(22) Filed: May 16, 2001

(51) Int. Cl.[7] ..... B43K 23/12

(52) U.S. Cl. ..... 401/247; 401/61; 401/98; 401/202; 401/213; 401/243; 401/244

(58) Field of Search ..... 401/61, 98, 124, 401/202, 213, 243–247, 262, 269; 24/11 R, 11 S; D19/56

(56) References Cited

U.S. PATENT DOCUMENTS 3,323,494 A * 6/1967 Mutschler ..... 401/247
3,882,572 A * 5/1975 Hocq ..... 24/11 S
4,706,341 A * 11/1987 Celaries ..... 401/243
4,837,900 A * 6/1989 Boyce et al. ..... 401/202
5,570,965 A * 11/1996 Coolen ..... 401/98

FOREIGN PATENT DOCUMENTS

DE 3903415 A1 * 8/1990 ..... B43K/09/00

* cited by examiner

*Primary Examiner*—Michael Powell Buiz
*Assistant Examiner*—Tuan Nguyen
(74) *Attorney, Agent, or Firm*—Vinson & Elkins L.L.P.

(57) ABSTRACT

A pen includes a vertical pen barrel, a mounting seat mounted fixedly on a top end of the pen barrel, and a molded metal unitary unit. The unit includes a pen top disposed swingably on the seat, and a pen clip extending integrally and downwardly from the pen top. The clip has a clamping end, which is movable relative to the pen barrel between a clamping position, where the clamping end presses against the pen barrel, and a releasing position, where the clamping end is spaced apart from the pen barrel. A biasing unit biases the clip to the clamping position.

2 Claims, 4 Drawing Sheets

MOLDED PEN CAP WITH BIASING CLIP

TECHNICAL FIELD OF THE INVENTION

This invention relates to an assembly of a metal pen clip and a metal pen top that is retained on an end of a pen barrel, more particularly to a molded unitary metal assembly of a pen clip and a pen top, which has a three-dimensional ornamental effect and a satisfactory clamping force.

BACKGROUND OF THE INVENTION

The improvement of this invention is directed to a pen, which has a metal pen barrel, a metal pen top retained on an end of the pen barrel, and a pen clip that is connected fixedly to the pen top. It is desirable for pen consumers that an assembly of the pen top and the pen clip has a three-dimensional ornamental effect. Referring to FIG. 1, a first conventional pen is shown to include a molded unitary pen top 10 that is shaped as an eagle head, and a pen clip 11 that is secured to the pen barrel 13 by means of a hoop 12. The pen top 10 is formed with an integral tongue 14 that is press fitted within an end of the pen barrel 13. Exposure of the hoop 12 among the pen top 10, the clip 11 and the pen barrel 13 has an adverse affect on the aesthetic design of the pen. Furthermore, because the pen top 10 and the clip 11 are two separate members, the pen appears like a patchwork, which is not satisfactory for the consumers. Although a molded metal unitary assembly of a pen top and a pen clip has been proposed heretofore in order to solve this problem, a pen clip of such a casting assembly would be relatively thick due to the need for the casting process, thereby resulting in a poor clamping force. Referring to FIG. 2, a second conventional pen is shown to include a pressed metal assembly of a pen clip 20 and a pen top 21, which may be unitary. However, the shape of the pressed metal assembly is difficult to present a three-dimensional ornamental effect.

SUMMARY OF THE INVENTION

An object of this invention is to provide a pen with a molded unitary metal assembly of a pen clip and a pen top, which has a three-dimensional ornamental effect and a satisfactory clamping force.

According to this invention, a pen includes a vertical pen barrel, a mounting seat mounted fixedly on a top end of the pen barrel, and a molded metal unitary unit. The unit includes a pen top disposed swingably on the seat, and a pen clip extending integrally and downwardly from the pen top. The clip has a clamping end, which is movable relative to the pen barrel between a clamping position, where the clamping end presses against the pen barrel, and a releasing position, where the clamping end is spaced apart from the pen barrel. A biasing unit biases the clip to the clamping position.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE INVENTION

Figure 2:
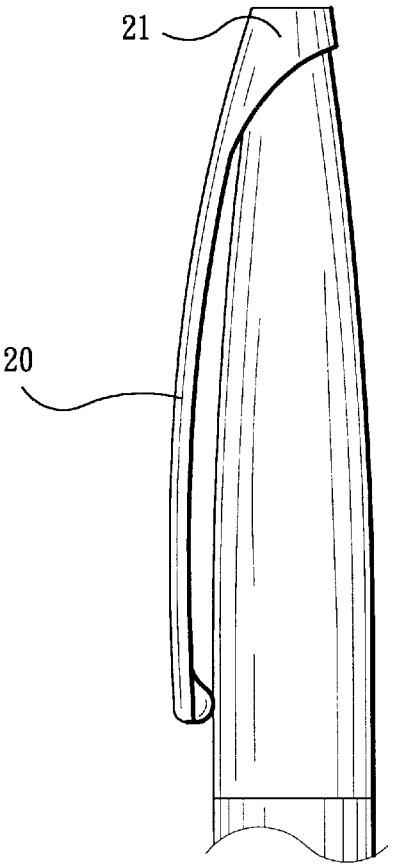
FIG. 2 PRIOR ART
FIG. 2 is a schematic fragmentary view of a second conventional pen.
Figure 1:
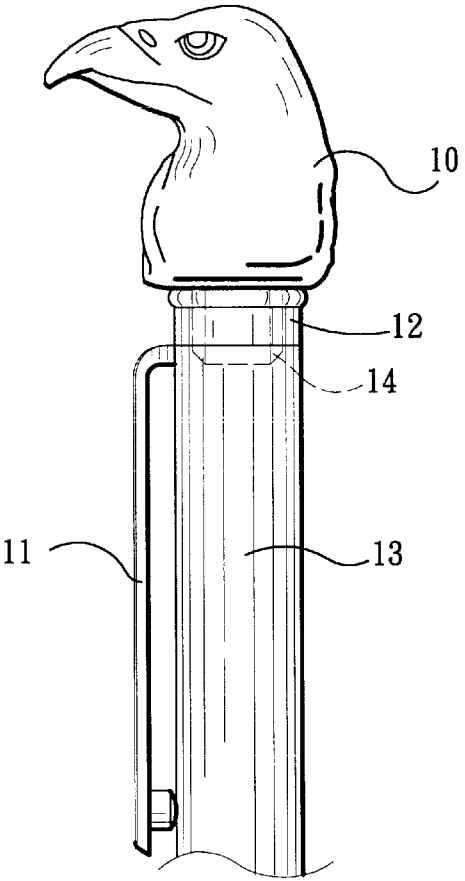
FIG. 1 PRIOR ART
FIG. 1 is a schematic fragmentary view of a first conventional pen.

Before the present invention is described in greater detail with reference to the preferred embodiments, it would be understood that similar elements and structures are designated by like reference numbers throughout the entire disclosure.

Referring to FIGS. 3, 4, 5, and 6, a first preferred embodiment of a pen according to this invention is shown to include a molded metal unitary unit 3, a block 4, a mounting seat 5, a biasing unit 6, and a pen barrel 58. The seat 5 is unitary, and includes a truncated conical seat body 50, which has a top surface 51 that is formed with two parallel integral vertical walls 52, a confining space 53 defined between the walls 52, and a bottom surface 54 with a vertical hollow cylinder 55 that extends integrally and downwardly from an intermediate portion thereof The cylinder 55 is press fitted within an open top end 580 of the pen barrel 58, and has a vertical central hole 56 formed therethrough, which is communicated with a vertical small hole 57 in the seat body 50 and which has a diameter larger than that of the small hole 57. The small hole 57 is located between the walls 52.

The unit 3 includes a pen top 30 with a cross-shaped recess 32, and a pen clip 31 that extends integrally and downwardly from the pen top 30. The recess 32 has a straight main portion 34, and two wing portions 35 extending from two opposite sides of the main portion 34 and away from each other.

The block 4 is received fittingly and swingably within the confining space 53 between the walls 52 of the seat body 50, and is fixed within the straight main portion 34 of the recess 32 in the pen top 30, e.g. by a welding process. Alternatively, the unit 3 may be molded directly on the block 4 so as to fix the block 4 to the unit 3.

The biasing unit 6 includes a bolt 60 and a coiled compression spring 61. The bolt 60 extends through the small hole 57 in the seat body 50 and into the central hole 56 in the cylinder 55, and has a threaded top end 62 that engages threadably a threaded hole 40 in a bottom surface of the block 4. The spring 61 is sleeved on the bolt 60 and is disposed between the bottom surface 54 of the seat body 50 and an enlarged lower end head 63 of the bolt 60 so as to bias the bolt 60 to a vertical position shown in FIG. 5, where the bolt 60 is substantially parallel to the pen barrel 58, thereby moving the clamping end 310 of the pen clip 31 to a clamping position, where the clamping end 310 presses against the pen barrel 58 and where a clearance 500 is formed between a right side portion of the seat body 50 and a skirt portion 36 of the pen top 30.

Figure 3:
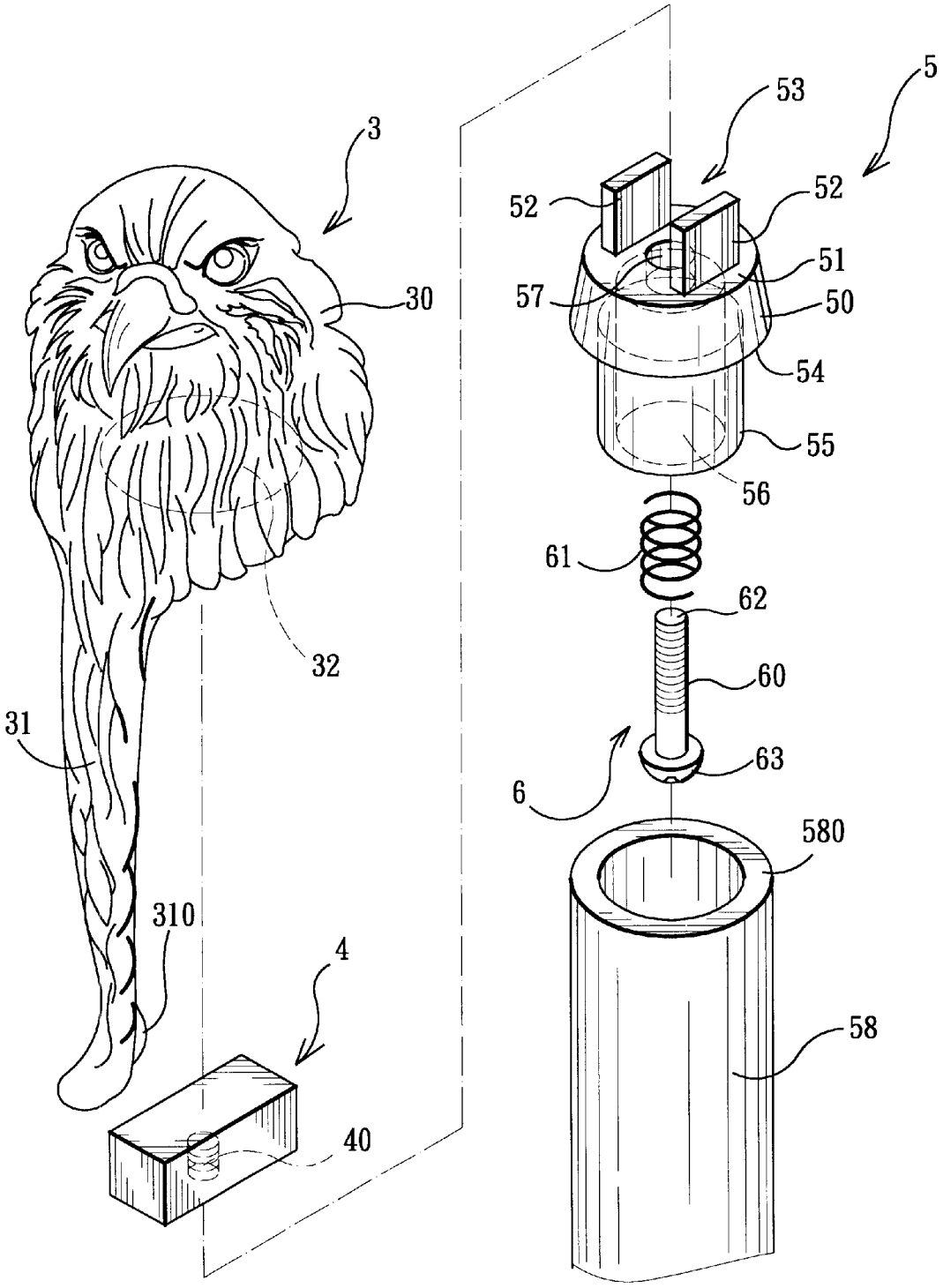
FIG. 3 is an exploded fragmentary perspective view of a first preferred embodiment of a pen according to this invention.
Figure 4:
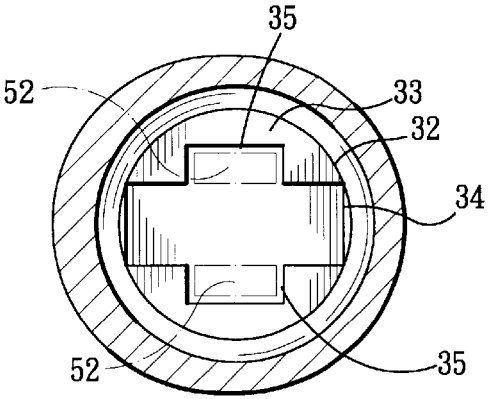
FIG. 4 is a schematic fragmentary sectional view of the first preferred embodiment, illustrating how a block and two vertical walls of a mounting seat are disposed within a cross-shaped recess in a pen top.
Figure 7:
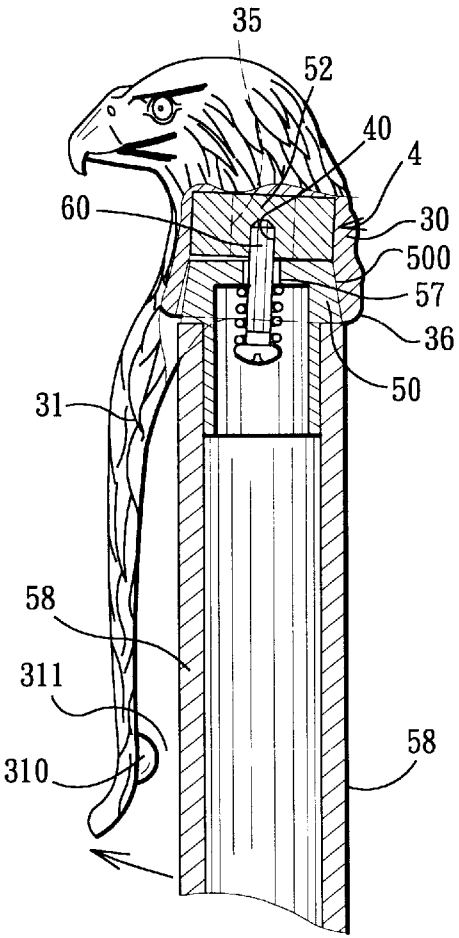
FIG. 7 is a schematic fragmentary sectional view of the first preferred embodiment, illustrating the movements of the block, and a bolt relative to the pen barrel when the clamping end of the pen clip is removed from the pen barrel.

Referring to FIGS. 3 and 4, the walls 52 are disposed respectively within the wing portions 35 of the recess 32 in the pen top 30. A space is formed among the walls 52 and the wall 33 of the pen top 30 (see FIG. 3) defining the wing portions 35, and is large enough to permit movement of the pen top 30 relative to the seat 5 and pen barrel 58. As such, referring to FIG. 7, the clamping end 310 of the clip 31 can be moved to a releasing position, where the clamping end 310 is removed from the pen barrel 58 and where the bolt 60 is inclined relative to the pen barrel 58. The clamping end 310 is retained at the releasing position by abutting the right side portion of the seat 50 against the skirt portion 36 of the pen top 30. When the clamping end 310 of the clip 31 is released, the spring 61 biases the bolt 60 from the inclined position shown in FIG. 7 to the vertical position shown in FIG. 5.

Figure 6:
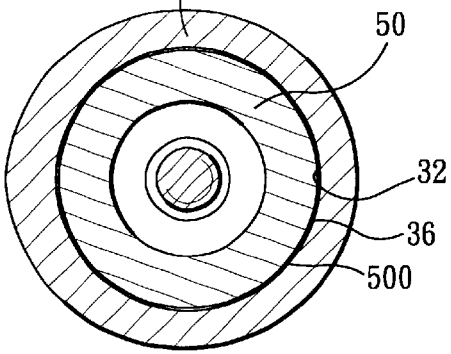
FIG. 6 is a sectional view of the first preferred embodiment, taken along Line 6—6 in FIG. 5.
Figure 5:
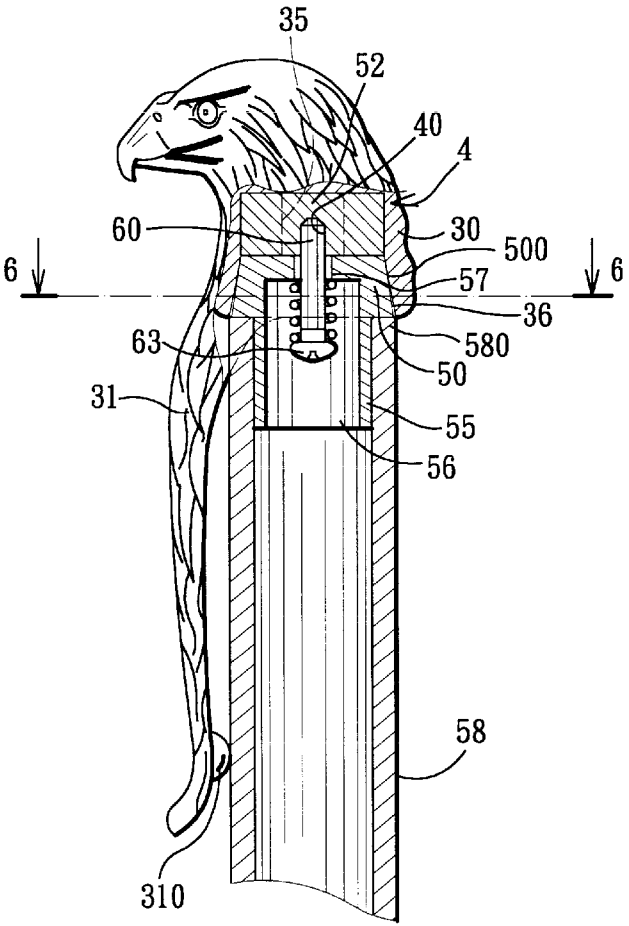
FIG. 5 is a schematic fragmentary sectional view of the first preferred embodiment, illustrating how a clamping end of a pen clip is biased by a spring to press against a pen barrel.
Figure 8:
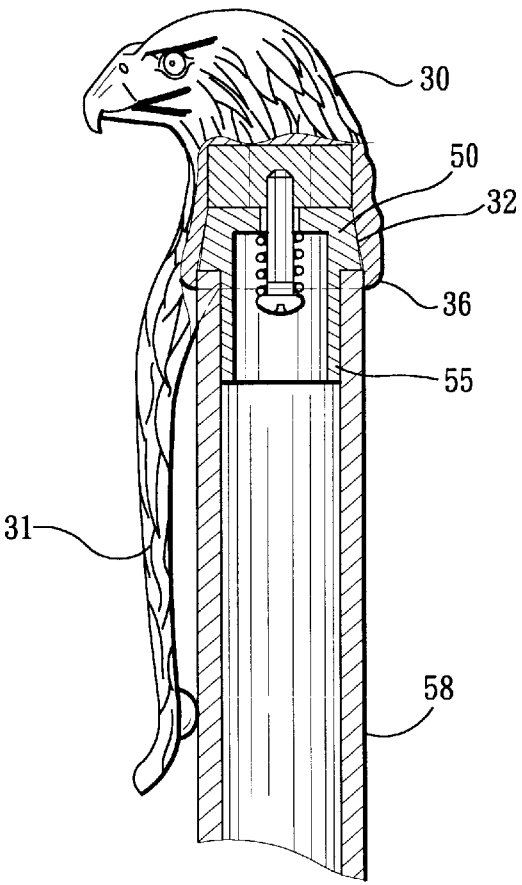
FIG. 8 is a schematic fragmentary sectional view, illustrating a modified pen top of the pen of this invention.

Referring to FIG. 6, the skirt portion 36 has a lower end, which is disposed at the same level as an upper end of the pen barrel 58 and which may extend downward to cover an end portion of the pen barrel 58 for appearance-improving purposes, as shown in FIG. 8.

With this invention thus explained, it is apparent that numerous modifications and variations can be made without departing the scope and spirit of this invention. It is therefore intended that this invention be limited only as indicated by the appended claims.

I claim:

1. A pen comprising:

a pen barrel;

a mounting seat mounted fixedly on a top end of said pen barrel;

a molded metal unitary unit including:

a pen top disposed swingably on said seat, and a pen clip extending integrally and downwardly from said pen top and having a clamping end, which is movable relative to said pen barrel between a clamping position, where said clamping end presses against said pen barrel, and a releasing position, where said clamping end is spaced apart from said pen barrel;

wherein, said pen top has a surface with a cross-shaped recess, which includes a straight main portion, and two wing portions that extend respectively from two opposite sides of said main portion and away from each other, said seat having a top surface, which is formed with two parallel integral vertical walls that define a confining space therebetween and that are disposed movably within said wing portions of said recess, said pen further including a block, which is fixed within said main portion of said recess in said pen top and which is received fittingly and swingably within said confining space between said vertical walls of said seat; and;

a biasing unit for biasing said clip to the clamping position.

2. The pen as claimed in claim 1, wherein said top end of said pen barrel is open, said seat including a seat body that is formed integrally with said vertical walls and that has a bottom surface, and a hollow vertical cylinder that extends integrally and downwardly from an intermediate portion of said bottom surface of said seat body and that is press fitted within said top end of said pen barrel, said cylinder having a vertical central hole formed therethrough, said seat body having a vertical small hole formed therethrough, which has a diameter smaller than that of said central hole in said cylinder and which is in communication with said central hole, said block having a bottom surface that is formed with a threaded hole, said biasing unit including a vertical bolt and a coiled compression spring, said bolt extending through said small hole in said seat body and into said central hole in said cylinder and having a threaded top end that engages threadably said threaded hole in said block, a lower end that is formed with an enlarged integral head, and a diameter smaller than that of said small hole in said seat body so that said bolt can move within said small hole in said seat body between a vertical position and an inclined position, said spring being sleeved on said bolt between said bottom surface of said seat body and said head of said bolt so as to bias said bolt to the vertical position, thereby pressing said clamping end of said pen clip against said pen barrel.

* * * * *